US006181251B1

(12) United States Patent
Kelly

(10) Patent No.: US 6,181,251 B1
(45) Date of Patent: Jan. 30, 2001

(54) COMBINATION SMOKE DETECTION DEVICE AND LASER ESCAPE INDICATOR

(76) Inventor: Robert R. Kelly, 1800 Ventura Blvd., Camarillo, CA (US) 93010

( * ) Notice: Under 35 U.S.C. 154(b), the term of this patent shall be extended for 0 days.

(21) Appl. No.: 09/491,584

(22) Filed: Jan. 25, 2000

Related U.S. Application Data

(63) Continuation-in-part of application No. 09/181,837, filed on Oct. 27, 1998, now abandoned.
(60) Provisional application No. 60/063,698, filed on Oct. 28, 1997.

(51) Int. Cl.[7] ..... G08B 17/10
(52) U.S. Cl. ..... 340/628; 340/691.1; 340/693.6; 362/147; 362/259; 40/540; 40/560
(58) Field of Search ..... 340/628, 691.1, 340/693.5, 693.6, 693.9, 693.11, 693.12; 362/147, 259, 269; 40/540, 560, 570

(56) References Cited

U.S. PATENT DOCUMENTS

| | | | | |
|---|---|---|---|---|
| 4,148,023 | | 4/1979 | Elkin | 340/628 |
| 4,199,754 | | 4/1980 | Johnson et al. | 340/577 |
| 4,489,308 | * | 12/1984 | Logan, Jr. et al. | 340/628 |
| 4,570,155 | | 2/1986 | Skarman et al. | 340/531 |
| 4,649,376 | | 3/1987 | Frank | 340/691 |
| 4,763,115 | * | 8/1988 | Cota | 340/628 |
| 4,801,928 | | 1/1989 | Minter | 340/691 |
| 4,808,977 | * | 2/1989 | Hedrick | 340/691 |
| 5,140,301 | | 8/1992 | Watanabe | 340/332 |
| 5,572,183 | | 11/1996 | Sweeney | 340/332 |
| 5,594,410 | | 1/1997 | Lucas et al. | 340/332 |
| 5,612,665 | | 3/1997 | Gerhardsen | 340/332 |

* cited by examiner

*Primary Examiner*—Jeffery A. Hofsass
*Assistant Examiner*—Toan Pham
(74) *Attorney, Agent, or Firm*—Eric Karich

(57) ABSTRACT

A combination smoke detection device and laser escape indicator provides a primary circuit that electrically connects a power source to a laser. The primary circuit has a smoke detector switch that is operably controlled by a smoke detecting means. When the smoke detecting means detects smoke, it closes the smoke detector switch, thereby activating the laser to produce a laser beam. The laser is mounted on a swivel arm that is pivotally connected to a primary housing, the primary housing being rotatably attached to a base housing. The swivel arm and the primary housing together can be adjusted so that the laser projects the laser beam in a desired direction. When the combination is installed in a structure, the laser is manipulated so that when the laser generates a laser beam, the laser beam directs people to an exit from the structure. The primary circuit is preferably also connected to a siren, so when the laser is triggered, an audible siren is also activated, providing people within the structure with a warning of the fire.

13 Claims, 4 Drawing Sheets

COMBINATION SMOKE DETECTION DEVICE AND LASER ESCAPE INDICATOR

BACKGROUND OF THE INVENTION

This application for a utility patent is a continuation-in-part of a previously filed utility patent, now abandoned, having the application Ser. No. 09/181,837, filed Oct. 27, 1998 abandoned. This application for a utility patent also claims the benefit of U.S. Provisional application Ser. No. 60/063,698, having a filing date Oct. 28, 1997.

FIELD OF THE INVENTION

This invention relates generally to smoke detectors, and more particularly to a smoke detector that provides a laser beam to guide people to an exit when there is a fire.

DESCRIPTION OF RELATED ART

Smoke detectors are well known in the prior art; and two examples of modem smoke alarms are provided in U.S. Pat. Nos. 4,827,244 to Bellavia, and 4,166,960 to Meili. Typically, smoke detectors simply provide an audible alarm to alert people nearby that there is a fire.

Improved smoke detectors not only sound an alarm when smoke is detected, they also activate powerful lights or flashing strobes to help direct people to an exit. Frank, U.S. Pat. No. 4,649,376, for example, discloses the use of powerful flashing Xenon lamps to pierce smoke and direct people to the exit. Other examples of this technology are described in U.S. Pat. No. 4,148,023 to Elkin, 4,570,155 to Skarman, and 4,763,115 to Cota. While these devices can be useful in some circumstances, the flashing incandescent lights can tend to daze and confuse rather than direct, especially in a smoky room where it may not be apparent where the flashes of light are originating. Furthermore, intense flashing lights destroy night vision, often causing more harm than good to confused people trying to escape a dark building. To appreciate the problems inherent in this technology it is useful to understand that Xenon lamps are used in flash bulbs. It is easy to imagine having flash bulbs flashed in one's face while trying to escape a burning building in the dark—they may confuse rather than guide. None of these references disclose the use of lasers or pulsed lasers, which have properties entirely different than non-coherent lights.

Cota, U.S. Pat. No. 4,763,115, further discloses the use of a redundant circuit that is activated by a central audio alarm to trigger the smoke alarm and slashing circuits. While this is a useful feature, it does not disclose the use of a network of lasers to activate a plurality of smoke detectors as well as light a path through a building to an exit.

The state of the art is disclosed in U.S. Pat. Nos. 5,572,183 to Sweeney, and 5,140,301 to Watanabe. Sweeney, U.S. Pat. No. 5,572,183, discloses a device that sweeps a laser beam across a plurality of mirrors. Each mirror directs the laser beam into the floor at a different location, thereby "walking" that apparent laser beam towards an exit. Watanabe, U.S. Pat. No. 5,140,301, discloses a centrally controlled network that generates a laser which is guided and oscillated by a controlling mirror. Neither of these devices disclose a battery operated device that is self-contained within a housing that can be installed to form a comprehensive fire escape network. None of the prior art devices can be easily installed and adjusted in the place of traditional wall or ceiling mounted smoke detectors. And none of these devices teach the use of a pulsed laser to provide directional information to people attempting to escape a fire.

The present invention fulfills these needs and provides further related advantages as described in the following summary.

SUMMARY OF THE INVENTION

The present invention teaches certain benefits in construction and use which give rise to the objectives described below.

The present invention provides a combination smoke detection device and laser escape indicator. The combination includes a primary circuit that electrically connects a power source to a laser. The primary circuit has a smoke detector switch that is operably controlled by a means for detecting smoke. When the smoke detecting means detects smoke, it closes the smoke detector switch, thereby activating the laser to produce a laser beam. The laser is mounted on a means for pointing the laser in a desired direction. When the combination is installed in a structure, the laser is manipulated so that when the laser generates a laser beam, the laser beam will point towards a preferred exit from the structure. The primary circuit is preferably also connected to a siren, so when the laser is triggered, an audible siren is also activated, providing people within the structure with a warning of the fire.

A primary objective of the present invention is to provide a combination smoke detection device and laser escape indicator having advantages not taught by the prior art.

Another objective is to provide a smoke detection device that is self-contained, battery operated, and internally adjustable to project a laser beam towards an exit without the use of external directional devices.

Another objective is to provide a smoke detection device having a pulsed laser, the pulsed laser producing a pulsed laser beam whose movement can be perceived by people and followed to the exit.

A further objective is to provide a smoke detection device having a means for pointing the laser beam that is easy to install, adjust, and maintain.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
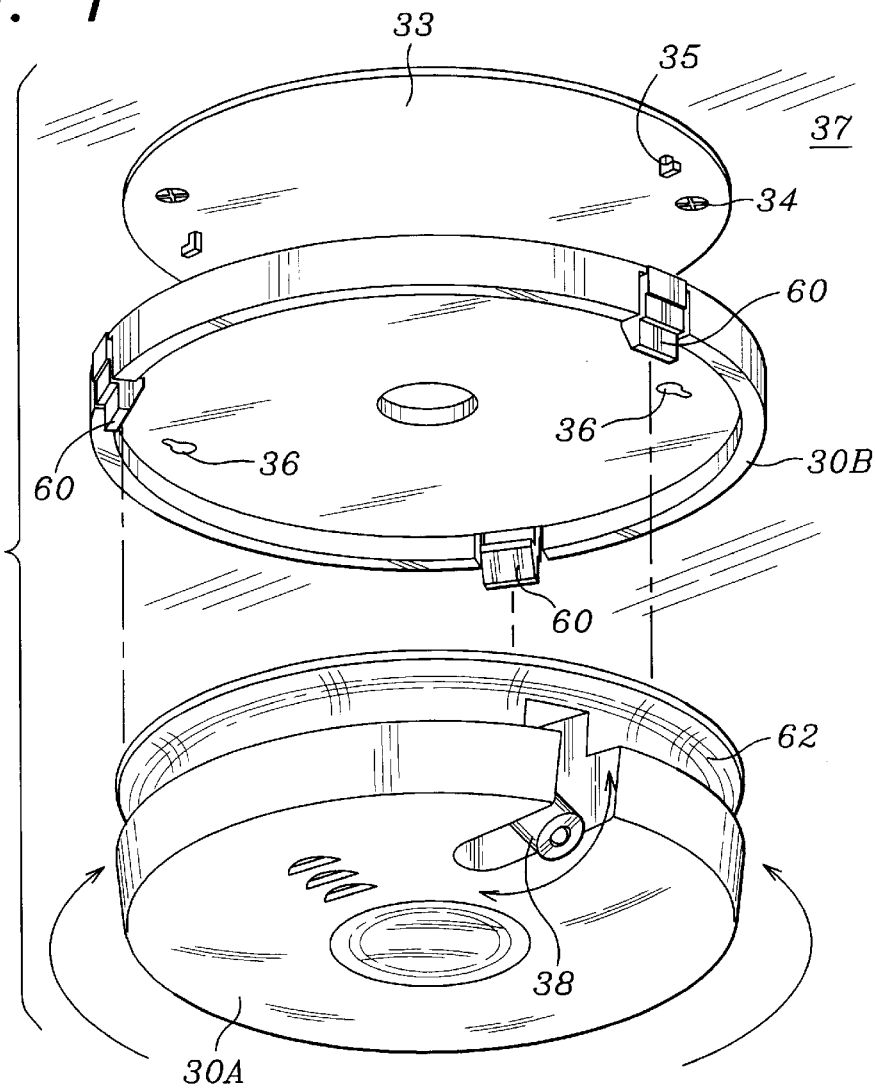
FIG. 1 is an exploded perspective view of the preferred embodiment of the present invention.
Figure 2:
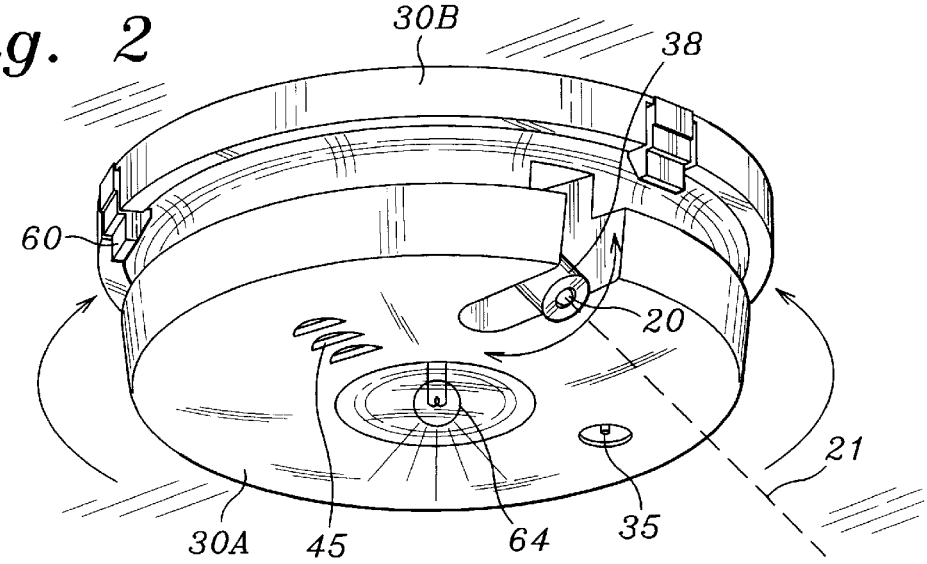
FIG. 2 is a perspective view thereof showing a light and a laser in their activated states.
Figure 3:
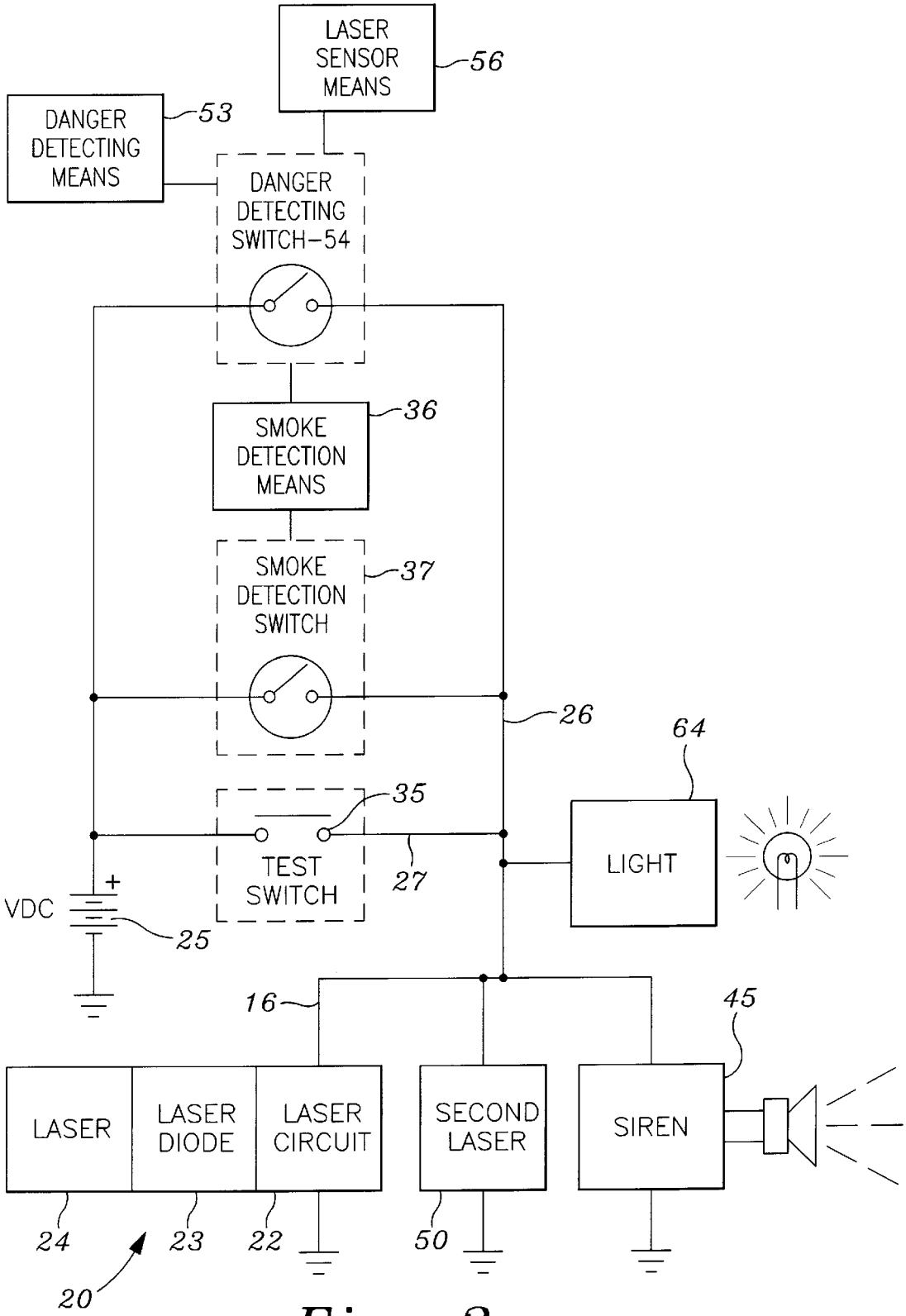
FIG. 3 is a schematic diagram of the combination smoke detection device and laser escape indicator.

The above described drawing figures illustrate the invention, a combination smoke detection device and laser escape indicator 10. The preferred embodiment of the combination 10, shown in FIGS. 1 and 2, is a self-contained device that projects a laser beam 21 from a housing 30 towards an exit from a structure. As shown in FIG. 3, the combination 10 includes a primary circuit 26 that electrically connects a power source 25 to a laser 20. The primary circuit 26 has a smoke detector switch 37 that is operably controlled by a means for detecting smoke 36. When the smoke detecting means 36 detects smoke, it closes the smoke detector switch 37, thereby activating the laser 20. The laser 20 is mounted on a means for pointing 40 the laser 20 in a desired direction. When the combination 10 is installed in a structure, the laser 20 is manipulated so that when it generates a laser beam 21, the laser beam 21 will point towards the exit from the structure.

Laser

As shown in FIG. 3, the laser 20 is preferably a laser module that includes a laser circuit 22, a laser diode 23, and at least one laser optic 24. The laser circuit 22 is operably connected to the laser diode 23 to generate coherent light which is focussed by the laser optic 24 to form a laser beam 21. Such laser modules are well known in the art and are therefore not discussed in detail. The laser diode 23, shown in FIG. 1, is preferably a Class 3A diode using 3–12 volts and having a 1–5 milliwatt pulsed output in the visible spectrum, most preferably in the 630–670 nm range. The laser beam 21 is preferred pulsed because the pulses help guide people in the correct direction. Patridge et al., U.S. Pat. No. 5,121,188, describes an acceptable laser module, and is hereby incorporated by reference in fill. Those skilled in the art, however, will be able to devise alternative laser modules that are acceptable for the practice of this invention. It is also possible to include more than one laser module 20 with the combination 10, as further discussed below.

Power Source

Since the preferred embodiment of this invention is a stand alone device and self contained device that does not require a complex network to maintain, the power source 25 shown in FIG. 3 is preferably a battery, most preferably a pair of common 9 volt batteries. However, those skilled in the art can adapt the combination 10 to be powered by many alternative sources of power. For example, in many commercial smoke alarm systems many detectors throughout the structure are powered by direct connection to a central power source, the central power source usually having an additional battery backup (not shown). The power source 25 should be selected according to the needs of the user by those skilled in the art; and those skilled in the art can then adapt the rest of the combination 10 to accommodate the power source 25 that has been selected.

Smoke Detecting Means

The smoke detecting means 36 is preferably a sensor unit selected from a variety of acceptable smoke sensors well known in the art. An acceptable smoke sensor 36 and an acceptable smoke detector switch 37 are found in the smoke detector sold by FIRST ALERT®, of Aurora, Ill., as model number SA150LTD, and described in Bellavia et al., U.S. Pat. No. 4,827,244, herein incorporated by reference in full. Other acceptable smoke detecting means 36 and smoke detector switches 37 are described in the following patents: Meili, U.S. Pat. Nos. 4,166,960 to Meili, 3,143,161 to Graves, and 3,530,450 to Walthard. These patents are all hereby incorporated by reference in full. Those skilled in the art can easily select the proper components from a wide variety of known designs.

While we refer specifically to a smoke detecting means 36, it is important to note that this invention is not specifically limited to detecting smoke. As shown in FIG. 3, the combination 10 can be activated by a means for detecting danger 52 which is operably connected to a danger detector switch 54 in the primary circuit 26. The means for detecting danger 52 can be provided by one or more of the many sensors that exist in the prior art for detecting earthquakes or other disasters, and these sensors are considered equivalent to the smoke detecting means 36. Several types of "abnormal condition" sensors are discussed in Watanabe, U.S. 5,140,301, hereby incorporated by reference.

The danger detector switch 54 may also be operably connected to a means for sensing 56 the laser beam 21 from another combination 10, preferably a laser sensor such as can be devised by those skilled in the art which can sense. As shown in FIG. 3, the laser sensor 56 triggers the danger detector switch 54 to close the primary circuit 26 and activate the combination 10. The inclusion of the laser sensor 56 allows a chain of the combinations 10 to be used to direct people around corners to the exit, with each combination 10 triggering the next in a "domino effect" whenever one of the combinations 10 senses smoke.

Figure 5:
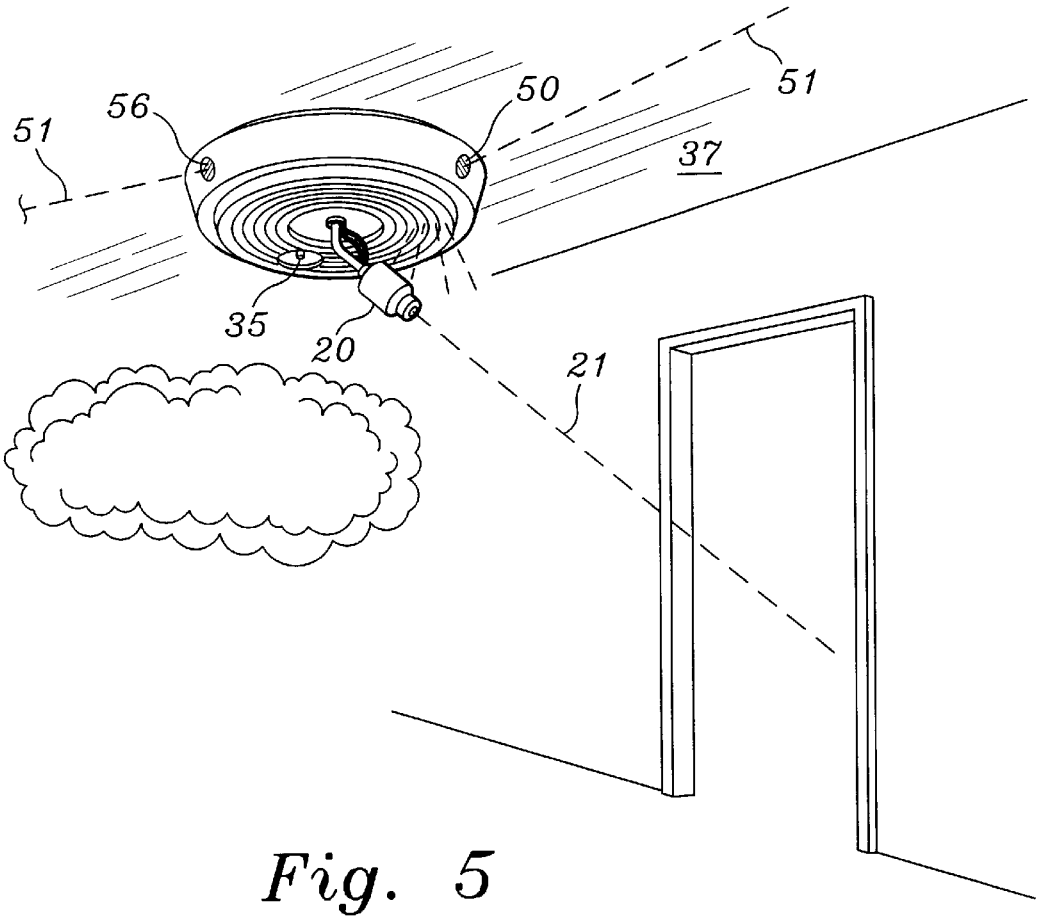
FIG. 5 is a perspective view thereof, showing smoke triggering the smoke alarm and causing the laser module to generate the laser beam thereby guiding persons to the exit.

In a second embodiment, as shown in FIG. 5, the combination 10 further includes a second laser 50 that generates a second laser beam 51 to trigger the laser sensor 56, thereby spreading an alarm throughout the structure. In use, a network of the combinations 10 are used, each combination 10 having a laser 20 and at least one second laser 50. Either the laser 20 or the second laser 50 of each combination 10 can be used to direct people to the exit or to trigger another one of the combinations 10. When one of the combinations 10 is activated, the combinations 10 not only direct people to the exit, they also activate the other combinations 10 in the network. Such a network of stand alone detectors can spread an alarm throughout the structure even without a centrally managed fire alarm system.

The specific structure of the second laser 50 and the laser sensor 56 can be modified by those skilled in the art to suit a particular embodiment. For example, in one embodiment the second laser beam 51 is in the visible spectrum, thereby allowing the user to provide a network of the combinations 10 that together lead a user from the structure. In another embodiment, the second laser beam 51 is not in the visible spectrum, thereby allowing the user to activate a network of the combinations 10 without possibly confusing the location of the exit. A modified or customized version of the above-described structure, such as may be accomplished by those skilled in the art, is considered equivalent and should be construed as within the scope of the following claims.

Housing

The primary circuit 26 and the above-described sensors 36, 52, and 56 are mounted within a housing 30, preferably a heat resistant plastic container that contains and protects the elements stored within. The housing 30 is removably attachable to the surface 37, preferably with a mounting bracket 33. In its preferred embodiment, the housing 30 is sized and shaped to correspond to a prior art smoke detector. The housing 30 is preferably shaped to removably engage a mounting bracket 33, The mounting bracket 33 is preferably secured to the surface 37 with bracket screws 34. The mounting bracket 33 preferably has outwardly extending bracket locking arms 35 shaped to removably engage bracket locking holes 36 in the back surface of the housing 30. Such a mounting mechanism is already used in the prior art. Indeed, the mounting bracket 33 is preferably the same size and shape as prior art mounting brackets; therefore, in the preferred embodiment, the combination 10 can be mounted in place of a prior art smoke detector by the same mounting bracket that was used for the old smoke detector.

Test Circuit

In its preferred embodiment, as shown in FIG. 3, the combination 10 includes a test circuit 27 that electrically connects the power source 25 to the laser module 20. The test circuit 27 includes a test switch 35, preferably a manually operated test button. By pressing the test button 35, located on the exterior of the housing 30, the user is able to test the laser module 20 and the power source 25. By manually activating the laser module 20, the user also facilitates aiming the laser beam 21 to correspond to the exit. In its preferred embodiment, the primary circuit 26 and the test circuit 27 are contained on a circuit board.

Light and Siren

In its preferred embodiment, as shown in FIG. 3, the primary circuit 26 and the test circuit 27 also connect the power source 25 to an audible warning means 45, preferably a siren. In the most preferred embodiment, the primary circuit 26 and the test circuit 27 also connect the power source 25 to a light 64. When the laser module 20 is triggered, either by smoke, danger, the laser beam 21 of another combination, or by the user pressing the test button 35, the siren 45 and the light 64 are also activated. In the case of a fire, the siren 45 provides people within the structure with an audible warning of the fire and the light 64 helps the people see when no other light is available. In the case of someone pressing the test button 35, the siren 45 and light 64 confirm that the combination 10 is functioning and the power source 25 is connected and/or charged.

Pointing Means

The laser module 20 is mounted on a pointing means 40 for positioning the laser module 20 to point in a desired direction. In the preferred embodiment, as shown in FIGS. 1 and 2, the pointing means 40 is preferably provided by two features. First, the laser module 20 is attached to an adjustable swing arm 38 pivotally attached to the housing 30. Second, the housing 30 is constructed of a primary housing 30A rotatably attachable to a housing base 30B. The primary housing 30A is preferably attachable to the housing base 30B with three resilient clips 60 that extend from the housing base 30B to engage a peripheral lip 62 of the primary housing 30A. The attachment at the peripheral lip 62 allows primary housing 30A to rotate with respect to the surface 37 while the adjustable swing arm 38 pivots with respect to the housing 30, thereby allowing the user to adjust the laser module 20 to project the laser beam 21 in the desired direction.

Figure 4:
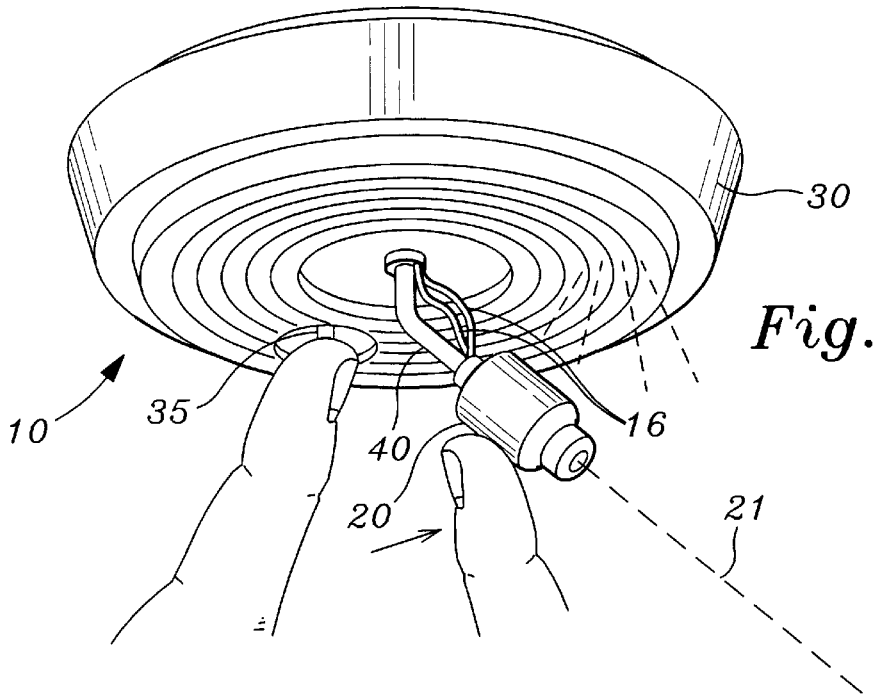
FIG. 4 is a perspective view of a second embodiment of the present invention showing a user pressing a test button causing the laser to generate a laser beam, the user also manipulating the laser module causing it to point towards a preferred exit.

In an alternative embodiment, shown in FIGS. 4 and 5, the pointing means 40 is a bendable connection connecting the laser module 20 to the housing 30. The connection 40 is preferably a rod or tube made of a bendable metal, the rod or tube preferably being surrounded by an outer sheath (not shown) made of plastic or rubber. The use is able to manipulate the laser module 20 by bending the connection 40. The connection 40 then maintains its new shape, thereby causing the laser module 20 to point in the desired direction. When the combination 10 is installed in a structure, the laser module 20 is manipulated so that when the laser module 20 generates a laser beam 21, the laser beam 21 will direct people towards the exit. In this alternative embodiment, a pair of electrical wires 16 electrically connect the laser module 20 to the primary and test circuits 26 and 27.

Figure 6:
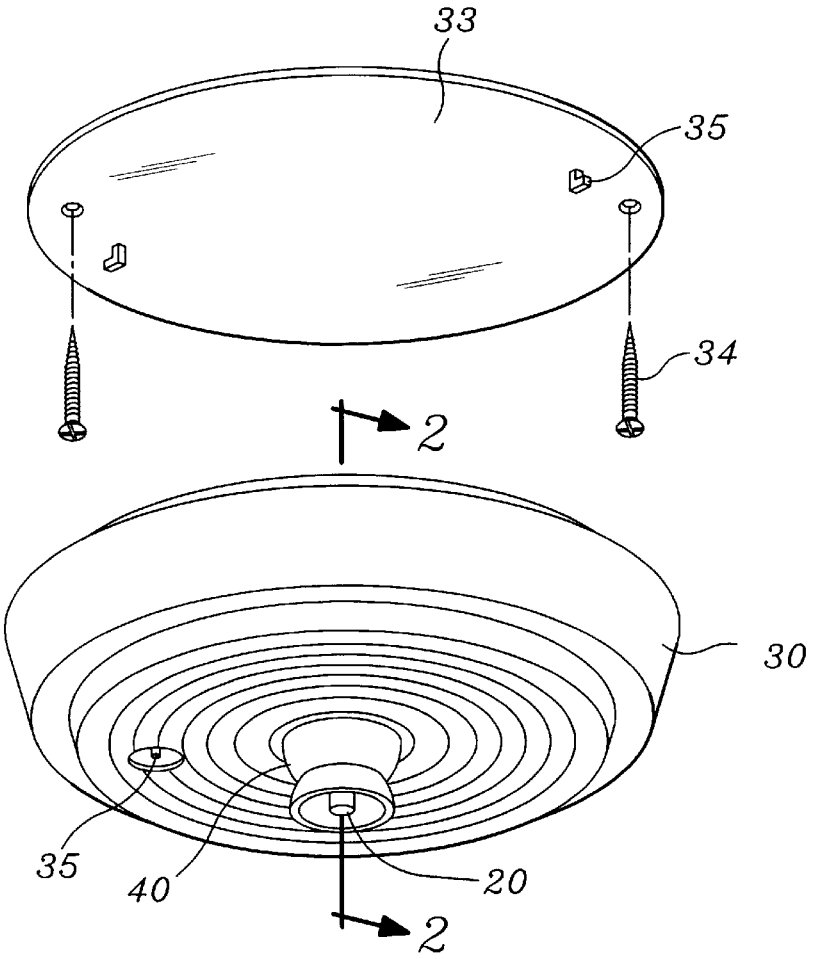
FIG. 6 is an exploded perspective view of a third embodiment of the present invention.
Figure 7:
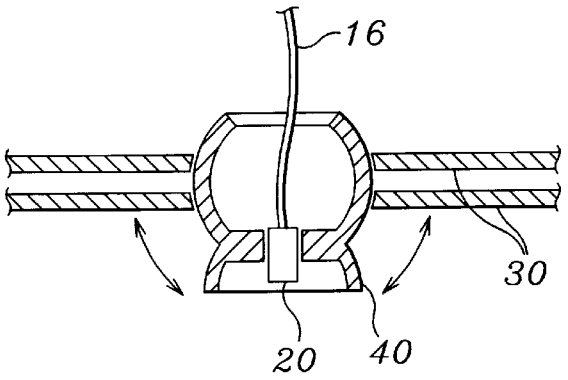
FIG. 7 is a side elevational sectional view taken along line 7—7 in FIG. 6.

In yet another alternative embodiment, shown in FIGS. 6 and 7, the pointing means 40 is a swivel housing pivotally connected to a housing 30. The laser module 20 is preferably mounted inside the swivel housing 40. The user then adjusts the swivel housing 40 so that the laser module 20 projects the laser beam 21 towards the preferred exit. While three examples of the pointing means 40 have been given, it is understood that those skilled in the art can easily devise other embodiments that perform the task of properly positioning the laser module 20 to aim the laser beam 21 towards the preferred exit. Other structures are considered within the scope and this invention and are considered equivalent to the current invention.

Method of Use

The invention further includes a method for directing a person to an exit of a structure that is on fire. The combination smoke detection device and laser escape indicator 10 described above is installed within the structure, preferably using the mounting bracket 33 described above. The bracket screws 34 are used to fasten the mounting bracket 33 to the surface 37 and the housing 30 is mounted upon the mounting bracket 33 by hanging the housing 30 on the bracket locking arms 35 of the mounting bracket 33 by the bracket locking holes 36.

The laser module 20 is mounted within the pointing means 40 and operably connected to the primary circuit as described above. Several embodiments of the pointing means 40 are described above, although this invention is not limited to these specific embodiments, and the inventions should be construed to include embodiments not specifically described herein but equivalent to these forms of pointing a laser module 20. It is important that the above-described structure is contained within the housing 30 and is not part of a complex smoke detection system that must be installed within and throughout the structure. The above described structure is self contained and can be installed in place of an ordinary prior art smoke detector such as is already used in homes throughout the world.

The user then presses the test button 35, activating the siren 45 and light 64, to make sure the battery 25 is charged and the rest of the combination 10 functions properly. Pressing the test button 35 also causes the laser module 20 to generate a laser beam 21. As shown in FIG. 4, once the laser beam 21 is activated, the user manipulates the laser module 20 so that a laser beam 21 is positioned to direct people within the structure to the exit. Once the combination 10 has been installed, the combination 10 will guide persons inside the structure to the exit when a fire occurs in the structure.

When a fire occurs, the smoke from the fire triggers the smoke sensor 36, closing the smoke detector switch 54 to complete the primary circuit 26 and connect the power source 25 to the laser module 20, the siren 45, and the light 64. Once the primary circuit 26 is complete, the siren 45 creates a loud audible noise and the laser module 20 generates a laser beam 21 that directs people towards the exit, as shown in FIG. 5. The people inside the structure, alerted by the siren 45, can follow the laser beam 21 through the smoke to the exit. As described above, the combination 10 preferably also includes the light 64 to assist people in their escape in the event that internal lighting within the structure is lost.

The laser 20 generates a visible line that directs people within the structure towards the exit; however, in many instances it may not be apparent which direction the people should travel, and they may be directed in the wrong direction back to the smoke detector. In the preferred embodiment, the laser beam 21 is also used to indicate the direction in which the user should proceed to find the exit.

One method used in the prior art to indicate direction is to manipulate the laser beam 21 itself, either by directing the laser beam 21 onto a plurality of different mirrors as shown in Sweeney, U.S. 5,572,183, or by oscillating the mirror itself, as in Watanabe, U.S. 5,140,301. In the preferred embodiment of the present invention, mirrors are not used. Instead of using mirrors to manipulate the direction of the laser beam, the preferred embodiment of this invention uses a laser beam 21 that is pulsed. The user is able to perceive the movement of the pulsed laser beam 21 and follow the pulses to the exit. This is not possible using the prior art laser directional devices because the human eye cannot perceive movement in a laser beam that is not pulsed. Since the user is not able to gather directional information from a continuous stationary laser beam, the prior art has always required the use of mirrors or other devices to move the beam. The introduction of a laser 20 that is pulsed is an important advance over the prior art.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A combination smoke detection device and laser escape indicator for mounting on a surface, the combination comprising:

a housing removably attachable to the surface;

a laser mounted on a means for pointing the laser in a desired direction, the laser pointing means being positioned on or within the housing; and a primary circuit electrically connecting a power source to the laser, the primary circuit having a smoke detector switch, the smoke detector switch being operably controlled by a means for detecting smoke, the primary circuit, the smoke detector switch, and the smoke detecting means all being positioned on or within the housing.

2. The combination of claim 1 wherein the power source is a battery mounted on or within the housing.

3. The combination of claim 2 wherein the battery is electrically connected to the laser with a test circuit, the test circuit having a test switch.

4. The combination of claim 1 wherein the laser is a laser module having a laser circuit operably connected to a laser diode, the laser diode cooperating with at least one laser optic to form a laser beam.

5. The combination of claim 1 wherein the laser pointing means is a bendable connection that mounts the laser on or within the housing.

6. The combination of claim 1 wherein the laser pointing means is a swivel housing pivotally attached on or within the housing, the swivel housing being movable to point the laser in a desired direction.

7. The combination of claim 1 wherein the housing includes a primary housing rotatably attachable to a housing base; and wherein the laser pointing means is provided by the combination of an adjustable swing arm pivotally attached to the primary housing and the rotation of the primary housing with respect to the housing base.

8. The combination of claim 1 wherein the laser is a pulsed laser.

9. A combination smoke detection device and laser escape indicator for mounting on a surface, the combination comprising:

a housing removably attachable to the surface;

a laser mounted on a means for pointing the laser in a desired direction, the laser pointing means being positioned on or within the housing;

a primary circuit electrically connecting a power source to the laser, the primary circuit having a smoke detector switch, the smoke detector switch being operably controlled by a means for detecting smoke, the primary circuit, the smoke detector switch, and the smoke detecting means all being positioned on or within the housing; and the primary circuit further including a danger detector switch operably controlled by a laser sensor, the danger detector switch operating to complete the primary circuit when activated by a second laser beam.

10. The combination of claim 9 further comprising a second laser operably connected by the primary circuit to the power source.

11. A method for directing a person to an exit of a structure that is on fire, the method comprising the steps of:

a) providing a combination smoke detection device and laser escape indicator, the combination including: a housing; a laser mounted on a means for pointing the laser in a desired direction, the laser pointing means being positioned on or within the housing; a primary circuit electrically connecting a power source to the laser, the primary circuit having a smoke detector switch, the smoke detector switch being operably controlled by a smoke detecting means, the primary circuit, the smoke detector switch, and the smoke detecting means being positioned on or within the housing; and a test circuit electrically connecting the power source to the laser, the test circuit having a test switch, the test switch being operably controlled by a test button, the test circuit, the test switch, and the test button being positioned on or within the housing;

b) installing the housing within the structure;

c) depressing the test button, thereby electrically connecting the laser to the power source so that the laser generates a laser beam;

d) adjusting the laser pointing means so that the laser beam points towards the exit from the structure; and e) releasing the test button.

12. The method of claim 11 wherein the laser is a pulsed laser that generates a pulsed laser beam.

13. The method of claim 11 wherein the power source is a battery.

* * * * *